US011001476B2

(12) United States Patent
Gong

(10) Patent No.: US 11,001,476 B2
(45) Date of Patent: May 11, 2021

(54) COMPENSATION CHAIN STABILIZE DEVICE AND METHOD, HOISTWAY AND ELEVATOR SYSTEM

(71) Applicant: Otis Elevator Company, Farmington, CT (US)

(72) Inventor: Xiaokai Gong, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 865 days.

(21) Appl. No.: 15/717,319

(22) Filed: Sep. 27, 2017

(65) Prior Publication Data

US 2018/0093865 A1 Apr. 5, 2018

(30) Foreign Application Priority Data

Sep. 30, 2016 (CN) ..... 201610870885.X

(51) Int. Cl.

| | |
|---|---|
| ***B66B 11/00*** | (2006.01) |
| ***B66B 7/06*** | (2006.01) |
| ***B66B 7/12*** | (2006.01) |
| ***B66B 9/00*** | (2006.01) |

(52) U.S. Cl.

CPC ..... *B66B 11/0005* (2013.01); *B66B 7/068* (2013.01); *B66B 7/1238* (2013.01); *B66B 9/00* (2013.01)

(58) Field of Classification Search

CPC ... B66B 11/0005; B66B 7/068; B66B 7/1238; B66B 9/00

USPC ..... 187/393

See application file for complete search history.

(56) References Cited

U.S. PATENT DOCUMENTS

| | | | | |
|---|---|---|---|---|
| 3,882,968 | A | 5/1975 | Suozzo | |
| 3,885,773 | A | 5/1975 | Dunkelberger | |
| 5,027,925 | A * | 7/1991 | Kahkipuro | B66B 7/06 187/292 |

(Continued)

FOREIGN PATENT DOCUMENTS

| | | | |
|---|---|---|---|
| CN | 1110440 | C | 6/2003 |
| CN | 201825611 | U | 5/2011 |

(Continued)

OTHER PUBLICATIONS

Chinese Office Action for application CN 201610870885.X, dated Apr. 24, 2020, 51 pages (Continued)

*Primary Examiner* — David S Warren

(74) *Attorney, Agent, or Firm* — Cantor Colburn LLP

(57) ABSTRACT

The present invention provides a compensation chain stabilizing apparatus and method, and an elevator shaft and elevator system having the same. The compensation chain stabilizing apparatus for an elevator includes a magnetic field generating device, which is configured to generate a magnetic field to limit shaking of the compensation chain. The elevator shaft and elevator system according to embodiments of the present invention include the compensation chain stabilizing apparatus according to the embodiments of the present invention. The apparatuses and methods of the present invention can suppress shaking of the compensation chain as much as possible, and avoid other problems related to the shaking of the compensation chain.

22 Claims, 1 Drawing Sheet

(56) References Cited

U.S. PATENT DOCUMENTS

| | | | | | |
|---|---|---|---|---|---|
| 5,255,759 | A * | 10/1993 | Kasai | B66B 11/0266 | 187/413 |
| 5,502,379 | A | 3/1996 | Hansel et al. | | |
| 5,581,180 | A * | 12/1996 | Ito | B61B 12/02 | 324/207.11 |
| 5,731,528 | A * | 3/1998 | Yamazaki | G01L 5/042 | 73/828 |
| 5,861,084 | A * | 1/1999 | Barker | B66B 7/06 | 187/264 |
| 6,267,205 | B1 * | 7/2001 | Piech | B66B 7/062 | 187/292 |
| 6,338,396 | B1 | 1/2002 | Morishita | | |
| 6,644,486 | B2 | 11/2003 | Jacoff et al. | | |
| 7,377,363 | B2 | 5/2008 | Flynn et al. | | |
| 7,793,763 | B2 * | 9/2010 | Zhu | B66B 7/06 | 187/411 |
| 8,011,478 | B2 * | 9/2011 | Utsunomiya | B66B 7/046 | 187/292 |
| 8,069,959 | B2 | 12/2011 | Oh et al. | | |
| 8,110,050 | B2 | 2/2012 | Smith et al. | | |
| 8,905,197 | B2 * | 12/2014 | Miller | F16F 6/005 | 187/401 |
| 9,914,619 | B2 * | 3/2018 | Roberts | B66B 5/022 | |
| 10,549,953 | B2 * | 2/2020 | Palazzola | B66B 5/0031 | |
| 10,737,907 | B2 * | 8/2020 | Guo | H01H 3/16 | |
| 2002/0179377 | A1 * | 12/2002 | Higaki | B66B 7/046 | 187/292 |
| 2003/0075389 | A1 * | 4/2003 | Otsuka | B66B 7/068 | 187/264 |
| 2004/0020725 | A1 * | 2/2004 | Utsunomiya | B66B 7/042 | 187/292 |
| 2004/0216962 | A1 * | 11/2004 | Kunz | B66B 1/3492 | 187/394 |
| 2005/0133312 | A1 * | 6/2005 | Kaczmarek | B66B 7/068 | 187/266 |
| 2006/0207835 | A1 * | 9/2006 | Kulak | B66B 7/044 | 187/292 |
| 2006/0254865 | A1 * | 11/2006 | Green | B66B 7/068 | 187/412 |
| 2008/0196981 | A1 * | 8/2008 | Liland | B66B 7/068 | 187/414 |
| 2010/0236872 | A1 * | 9/2010 | Miller | F16F 6/005 | 187/401 |
| 2012/0103731 | A1 * | 5/2012 | Sakuma | H01F 5/02 | 187/292 |
| 2015/0027814 | A1 * | 1/2015 | Benosman | B66B 7/06 | 187/247 |
| 2015/0166304 | A1 * | 6/2015 | Roberts | B66B 1/28 | 187/278 |
| 2015/0246791 | A1 * | 9/2015 | Smith | B66B 7/06 | 187/264 |
| 2016/0244298 | A1 * | 8/2016 | Roberts | B66B 1/34 | |
| 2017/0008736 | A1 * | 1/2017 | Blanc | B66B 9/02 | |
| 2018/0093865 | A1 * | 4/2018 | Gong | B66B 7/068 | |
| 2019/0292015 | A1 * | 9/2019 | Scoville | B66B 7/1215 | |

FOREIGN PATENT DOCUMENTS

| | | | | | |
|---|---|---|---|---|---|
| CN | 102112385 | A | 6/2011 | | |
| CN | 202704767 | U | 1/2013 | | |
| CN | 203699599 | U | 7/2014 | | |
| CN | 103991767 | A * | 8/2014 | G05B 15/02 | |
| CN | 204251135 | U | 4/2015 | | |
| EP | 2913289 | A1 | 9/2015 | | |
| EP | 3150538 | A1 * | 4/2017 | B66B 7/06 | |
| ES | 2066687 | A2 | 3/1995 | | |
| FI | 82918 | B | 1/1991 | | |
| JP | H0214899 | A | 1/1990 | | |
| JP | H0449189 | A | 2/1992 | | |
| JP | H05105349 | A | 4/1993 | | |
| JP | H05254757 | A | 10/1993 | | |
| JP | H09100079 | A | 4/1997 | | |
| JP | H09243942 | A | 9/1997 | | |
| JP | H09272675 | A | 10/1997 | | |
| JP | H1081466 | A | 3/1998 | | |
| JP | 2000034073 | A | 2/2000 | | |
| JP | 2002240391 | A | 8/2002 | | |
| JP | 2003104656 | A | 4/2003 | | |
| JP | 2004115184 | A | 4/2004 | | |
| JP | 2007309411 | A | 11/2007 | | |
| JP | 2009280349 | A | 12/2009 | | |
| JP | 2010018373 | A | 1/2010 | | |
| JP | 2014172725 | A | 9/2014 | | |
| WO | 0009435 | A1 | 2/2000 | | |
| WO | WO-2011055020 | A1 * | 5/2011 | B66B 7/10 | |

OTHER PUBLICATIONS

European Search Report for application EP 17192100.00, dated Mar. 2, 2018, 12 pages.

* cited by examiner

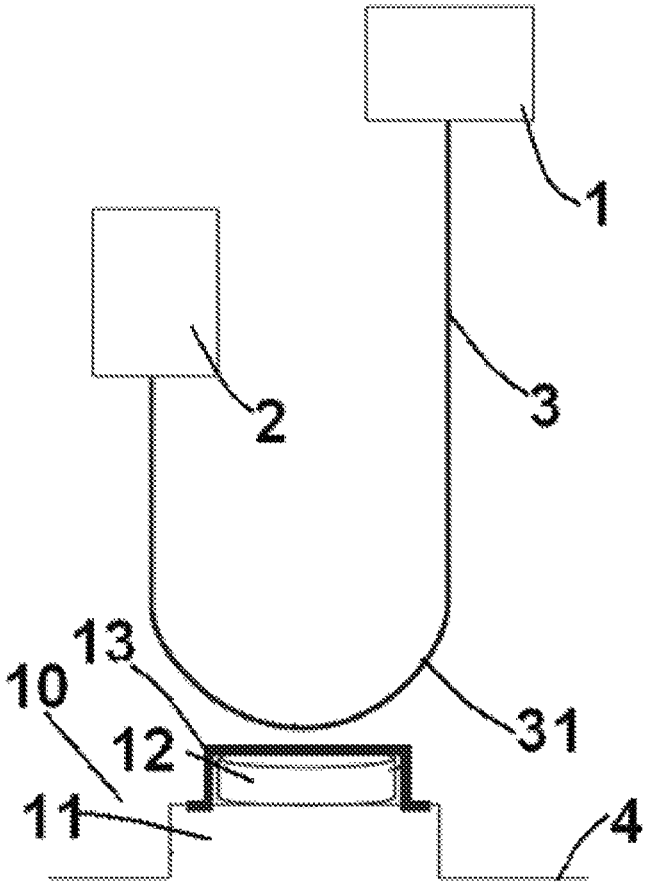
1
2
3
13
10
12
31
11
4

COMPENSATION CHAIN STABILIZE DEVICE AND METHOD, HOISTWAY AND ELEVATOR SYSTEM

FOREIGN PRIORITY

This application claims priority to Chinese Patent Application No. 201610870885.X, filed Sep. 30, 2016, and all the benefits accruing therefrom under 35 U.S.C. § 119, the contents of which in its entirety are herein incorporated by reference.

TECHNICAL FIELD

The present invention relates to the field of elevator technologies, and in particular, to a compensation chain stabilizing apparatus and method for an elevator, and an elevator shaft and elevator system having the compensation chain stabilizing apparatus or using the compensation chain stabilizing method.

BACKGROUND ART

During lifting of an elevator, in order to offset a change in the weight of an elevator traction rope as the elevator moves to different positions, a compensation chain is disposed between a car and the bottom of a counterweight support. The compensation chain generally includes a compensation chain body consisting of metal and a protective layer which wraps the compensation chain body and consists of, for example, a PVC rubber composite material. The compensation chain may shake during a startup or braking process or an acceleration or deceleration process of the elevator. Due to the shaking, the compensation chain may hit a buffer support or another mechanism provided at the bottom of an elevator shaft, which may thus generate noise. In some extreme conditions, the compensation chain may even hit the car.

SUMMARY OF THE INVENTION

An objective of the present invention is to solve or at least mitigate the problem existing in the prior art.

Another objective of the present invention is to provide a compensation chain stabilizing apparatus and method, and an elevator shaft and elevator system using such a compensation chain stabilizing apparatus or method, thereby suppressing shaking of the compensation chain as much as possible, and solving or at least mitigating other problems related to the shaking of the compensation chain.

According to an aspect of the present invention, a compensation chain stabilizing apparatus for an elevator is provided. The compensation chain stabilizing apparatus includes a magnetic field generating device, and the magnetic field generating device is configured to generate a magnetic field to limit shaking of the compensation chain.

According to another aspect of the present invention, an elevator shaft and an elevator system are provided, which include the compensation chain stabilizing apparatus according to an embodiment of the present invention.

According to another aspect of the present invention, a method for preventing shaking of a compensation chain is provided. The method includes: using a compensation chain at least partially made of a magnetic material, and disposing a magnetic field generating device near the compensation chain to limit shaking of the compensation chain.

BRIEF DESCRIPTION OF THE DRAWINGS

The foregoing and other features of the present invention will become obvious with reference to the accompanying drawing, where:

FIG. 1 is a schematic structural diagram of an elevator system according to an embodiment of the present invention.

DETAILED DESCRIPTION

It is easy to understand that, according to the technical solution of the present invention, those of ordinary skill in the art can propose multiple interchangeable structures and implementations without changing the essential spirit of the present invention. Therefore, the following specific implementations and accompanying drawing are merely exemplary description of the technical solution of the present invention, but should not be regarded as all of the present invention or limitations or restrictions on the technical solution of the present invention.

Orientation terms mentioned or possibly mentioned in the specification, such as upper, lower, left, right, front, rear, front surface, back surface, top, and bottom are defined relative to the structure shown in the accompanying drawing. The orientation terms are relative concepts, and therefore may change correspondingly according to different positions or different use statuses. Therefore, these or other orientation terms should not be interpreted as restrictive terms.

As shown in FIG. 1, an elevator system according to an embodiment of the present invention includes a car 1, a counterweight support 2, and a compensation chain 3 suspended between the car 1 and the bottom of the counterweight support 2. The compensation chain 3 is used to offset the weight of an elevator traction rope. The compensation chain 3 generally includes a metal chain body and a protective layer wrapping the metal chain body. The metal chain body is generally made of iron or other magnetic materials. The protective layer may be made of a composite material such as PVC rubber. As shown in the FIGURE, the compensation chain 3 includes a vertical portion under the car 1 and the counterweight support 2 and a U-shaped region 31 at the bottom of the compensation chain 3. Other parts of the elevator system are not the focus of the present invention, and therefore are not depicted herein or described in detail in the present invention. Those skilled in the art should understand that any existing or non-existing structures in the art may be used for other parts of the elevator system as required.

The elevator system further includes at least one compensation chain stabilizing apparatus 10 according to the present invention. The compensation chain stabilizing apparatus 10 according to the present invention includes a magnetic field generating device 12. The magnetic field generating device 12 can generate a magnetic field which acts on the compensation chain 3. Specifically, the magnetic field may attract the compensation chain 3, thus straining the compensation chain 3, to prevent shaking of the compensation chain 3. Although only one compensation chain stabilizing apparatus 10 is shown in FIG. 1, multiple compensation chain stabilizing apparatuses 10 may be disposed at different positions in an alternative embodiment. In the embodiment shown in FIG. 1, the compensation chain stabilizing apparatus 10 is disposed under the compensation chain 12. In an alternative embodiment, the compensation chain stabilizing apparatus 10 may further be disposed at another different position, as long as the magnetic field generated by the magnetic field generating device 12 of the compensation chain stabilizing apparatus 10 makes the compensation chain 3 tensioned, so that the compensation chain 3 does not shake easily. In some embodiments, two magnetic field generating devices 12 may be disposed on front and rear sides of the compensation chain 3 in FIG. 1, so that the compensation chain presents between the two magnetic field generating devices 12. In other words, the compensation chain 3 is sandwiched between the two magnetic field generating devices 12.

In some embodiments, the magnetic field generating device 12 may be a permanent magnet, such as magnetic iron. The magnetic field generated by the magnetic iron continuously acts on the compensation chain 3, and specifically attracts the compensation chain 3 at least partially made of a magnetic material, thereby straining the compensation chain 3, to prevent shaking of the compensation chain 3. In some other embodiments, the magnetic field generating device 12 may be an electromagnet, such as an electrified solenoid coil. The presence of the magnetic field or the intensity of the magnetic field may be controlled by means of on/off control or magnitude control of a current flowing through the electrified solenoid coil. In some embodiments, the compensation chain stabilizing apparatus 10 may include multiple sensors configured to sense an operation status of the elevator car 1 and a status of the compensation chain 3. In some embodiments, the magnitude of the current flowing through the electrified solenoid coil may be controlled in response to the operation status of the elevator car 1, thus controlling the presence of the magnetic field or the intensity of the magnetic field. For example, when it is sensed that the elevator car 1 remains stopped or off for a long time or when it is sensed that the elevator operates at a constant speed, the magnetic field is reduced or turned off. When the elevator accelerates, decelerates, starts up, or brakes, the magnetic field is increased to limit shaking of the compensation chain. In some embodiments, one or more sensors configured to sense the status of the compensation chain may be disposed, for example, a sensor configured to sense the position or displacement of the compensation chain. These sensors may be optical-based sensors. Specifically, the optical sensor includes an optical emitter and an optical receiver. The sensor is disposed in such a manner that when shaking of the compensation chain reaches a particular amplitude, the compensation chain obstructs light so that the optical receiver cannot receive light, thus feeding back the shaking amplitude of the compensation chain. Alternatively, the sensor may be disposed in such a manner that when shaking of the compensation chain reaches a particular amplitude, the compensation chain leaves to allow light to pass through, so that the optical receiver can receive light, thus feeding back the shaking amplitude of the compensation chain. In other embodiments, the sensor may also be a camera sensor or a non-contact-type or contact-type position or displacement sensor based on other principles. In some embodiments, the magnitude of the current flowing through the electrified solenoid coil may be controlled on the basis of the status (such as a position or displacement status) of the compensation chain sensed by the sensor, thus controlling the presence of the magnetic field or the intensity of the magnetic field. For example, the magnetic field is reduced or turned off when it is sensed that the shaking amplitude of the compensation chain is relatively small, and the magnetic field is increased when it is sensed that the shaking amplitude of the compensation chain is relatively large, so as to limit the shaking of the compensation chain.

In some embodiments, an isolating device is disposed between the magnetic field generating device 12 and the compensation chain 3. For example, in some embodiments, an isolating cover 13 as shown in the FIGURE may be used. The presence of the isolating cover 13 prevents direct contact between the compensation chain 3 and the magnetic field generating device 12. If the magnetic field generating device 12 is in direct contact with the compensation chain 3, an attractive force between the two may cause a relatively large friction between the two during movement of the compensation chain. The friction may abrade the compensation chain protective layer wrapping the compensation chain body, which is undesired, and the isolating device prevents occurrence of such a situation. In some embodiments, the isolating device should be made of a material that does not affect or hardly affects the magnetic field generated by the magnetic field generating device 12, or should be formed as a non-enclosed structure, such as a net-shaped structure or a structure having a hole. In this way, the isolating device does not affect the magnetic field generated by the magnetic field generating device 12. In some embodiments, the isolating device may also be other types of devices such as an isolating plate or an isolating net installed between the magnetic field generating device 12 and the compensation chain 3. In some embodiments, the isolating device may also be a laminate or a layer applied on a surface facing the compensation chain 3 of the magnetic field generating device 12. In order to maximize the effect of the magnetic field generated by the magnetic field generating device 12, the magnetic field generating device inevitably needs to be as close to the compensation chain 3 as possible. In some embodiments, a distance between the isolating device and the magnetic field generating device may be adjusted, thereby adjusting a minimum distance between the magnetic field generating device and the compensation chain, so that the intensity of the magnetic field at the position of the compensation chain is adjusted. To minimize the friction between the magnetic field generating device and the compensation chain, in some embodiments, at least the surface of the isolating device facing the compensation chain 3 is a smooth surface. In some embodiments, the isolating device may be made of a glass material, for example, an isolating cover or isolating plate made of a glass material, and so on.

In some embodiments, the compensation chain stabilizing apparatus 10 further includes a position adjustment device 11 for adjusting the position of the magnetic field generating device 12. For example, in some embodiments, the position adjustment device 11 may be an adjustable support on which the magnetic field generating device 12 can be arranged. The adjustable support can at least adjust a height position of the magnetic field generating device 12 in a vertical direction, so that the magnetic field of the magnetic field generating device 12 can be disposed at a suitable height, to facilitate adjustment of the intensity of the magnetic field at the position of the compensation chain 11. In some embodiments, the adjustable support may further adjust a vertical position of the magnetic field generating device 12 relative to the isolating cover 13, to facilitate adjustment of a distance between the magnetic field generating device 12 and the isolating cover 13, thus adjusting the intensity of the magnetic field acting on the compensation chain 3. During installation of the compensation chain 3, the height of the compensation chain 3 may have a certain installation error, and the compensation chain stabilizing apparatus provided with the adjustable support can apply to various on-site situations. The presence of the adjustable support ensures that the distance between the magnetic field generating apparatus and the compensation chain is in a suitable range. The distance is not so small that the compensation chain is dragged on the magnetic field generating device 12 or the isolating device, or so large that the magnetic field of the magnetic field generating device is insufficient to suppress shaking of the compensation chain. In some embodiments, the position adjustment device 11 may also adjust the position of the magnetic field generating device 12 on other degrees of freedom. For example, the position adjustment device 11 may further adjust a position of the magnetic field generating device 12 in a horizontal plane, so that the magnetic field generating device 12 is aligned with the bottom U-shaped region 31 of the compensation chain 3, or the magnetic field generating device 12 is adjusted to another appropriate position.

The maximum shaking amplitude of the compensation chain appears in the bottom U-shaped region 31 at the bottom of the compensation chain. In addition, especially in the bottom U-shaped region 31, the shaking amplitude of the compensation chain is maximum, and the compensation chain may hit a buffer support also at the bottom of the shaft or another device at the bottom of the shaft. Therefore, preferably, the magnetic field of the magnetic field generating device 12 is enabled to be applied on the bottom U-shaped region 31 of the compensation chain. To achieve this objective, the magnetic field generating device 12 may be disposed near the bottom U-shaped region 31 of the compensation chain, for example, under or on two sides of the bottom U-shaped region 31. In an embodiment in which the adjustment device 11 can adjust the horizontal position of the magnetic field generating device 12, the position of the magnetic field generating device 12 in a horizontal direction may be adjusted by using the adjustment device 11, so that the magnetic field generating device 12 is aligned with the bottom U-shaped region 31 of the compensation chain in the vertical direction or is positioned at an appropriate position on two sides of the bottom U-shaped region 31 of the compensation chain 3. Generally, a buffer support is further provided at the bottom of the shaft, and the compensation chain stabilizing apparatus 10 may be arranged near the buffer support, for example, on a side surface of or in front or rear of the buffer support.

In some other embodiments of the present invention, an elevator shaft is further provided. One or more compensation chain stabilizing apparatuses 10 according to the embodiments of the present invention are disposed in the elevator shaft. The compensation chain stabilizing apparatus 10 may be disposed at a bottom position or another position of the shaft. The presence of the compensation chain stabilizing apparatus 10 can prevent large-amplitude shaking of the compensation chain in the shaft. In tests, in a shaft with the compensation chain stabilizing apparatus provided at the bottom, the compensation chain only shakes once or twice with a small amplitude when the elevator car brakes, and then stops shaking. The small-amplitude shaking does not affect other facilities in the elevator shaft. In some embodiments, the elevator shaft has at least one compensation chain stabilizing apparatus 10 which is disposed at the bottom of the shaft and corresponds to the position of the compensation chain. For example, the compensation chain stabilizing apparatus 10 is disposed near the bottom U-shaped region 31 of the compensation chain, for example, under the bottom U-shaped region 31 of the compensation chain or at an appropriate position on two sides thereof. In some embodiments, the magnetic field generating device 12 of the compensation chain stabilizing apparatus 10 is aligned with the bottom U-shaped region 31 of the compensation chain in the vertical direction.

In some other embodiments of the present invention, an elevator system is further provided. The elevator system includes a shaft. The shaft is provided with a car 1, a counterweight support 2, and a compensation chain 3 installed between the car 1 and the bottom of the counterweight support 2. The compensation chain 3 is at least partially made of a magnetic material. The elevator system further includes one or more compensation chain stabilizing apparatuses 10 according to the embodiments of the present invention. The compensation chain stabilizing apparatus 10 includes a magnetic field generating device 12 which is configured to generate a magnetic field to limit shaking of the compensation chain 3. In some embodiments, the elevator system has at least one compensation chain stabilizing apparatus 10 which is disposed at the bottom of the shaft and corresponds to the position of the compensation chain 3. In some embodiments, the magnetic field generating device 12 of the compensation chain stabilizing apparatus 10 is aligned with the bottom U-shaped region 31 of the compensation chain in the vertical direction.

According to another aspect of the present invention, a method for preventing shaking of a compensation chain in an elevator system is provided. The method includes: using a compensation chain at least partially made of a magnetic material, and disposing a magnetic field generating device near the compensation chain to limit shaking of the compensation chain. In some embodiments, the method further includes disposing the magnetic field generating device at the bottom of a shaft and aligning the magnetic field generating device with a bottom U-shaped region of the compensation chain. In some embodiments, the method further includes disposing an isolating device between the magnetic field generating device and the compensation chain. In some embodiments, the method further includes disposing an isolating plate or an isolating cover, which has a smooth surface facing the compensation chain, between the magnetic field generating device and the compensation chain. In some embodiments, the method further includes adjusting a height position of the magnetic field generating device by using an adjustable support capable of adjusting a height in a vertical direction. In some embodiments, the method includes using a permanent magnet as the magnetic field generating device. In some embodiments, the method includes using an electromagnet as the magnetic field generating device. In some embodiments, the method includes operating the electromagnet based on an operation status of a car or a status of the compensation chain.

It should be noted that, all the preferred embodiments above are merely illustrative rather than limitative. Various modifications or transformations made by those skilled in the art to the specific embodiments described above under the conception of the present invention shall all fall in the legal protection scope of the present invention.

What is claimed is:

1. A compensation chain stabilizing apparatus for an elevator, wherein the compensation chain stabilizing apparatus comprises:

an electromagnet configured as a magnetic field generating device, and the magnetic field generating device is configured to generate a magnetic field to limit shaking of the compensation chain;

a sensor configured to sense at least one of shaking amplitude and position of the compensation chain;

a control device configured to control the electromagnet in response to the at least one of shaking amplitude and position of the compensation chain.

2. The compensation chain stabilizing apparatus of claim 1, wherein the sensor is an optical sensor.

3. The compensation chain stabilizing apparatus of claim 1, wherein the compensation chain stabilizing apparatus further comprises an isolating device configured to isolate the magnetic field generating device from the compensation chain.

4. The compensation chain stabilizing apparatus of claim 3, wherein the isolating device is an isolating plate, an isolating cover or an isolating net.

5. The compensation chain stabilizing apparatus of claim 3, wherein the isolating device has a smooth surface facing the compensation chain.

6. The compensation chain stabilizing apparatus of claim 3, wherein the isolating device is made of a glass material.

7. The compensation chain stabilizing apparatus of claim 1, wherein the compensation chain stabilizing apparatus further comprises a position adjustment device.

8. The compensation chain stabilizing apparatus of claim 7, wherein the position adjustment device can adjust a vertical height of the magnetic field generating device.

9. The compensation chain stabilizing apparatus of claim 7, wherein the position adjustment device can adjust a horizontal position of the magnetic field generating device.

10. The compensation chain stabilizing apparatus of claim 7, wherein the position adjustment device is an adjustable support disposed at the bottom of the magnetic field generating device.

11. An elevator shaft, wherein one or more compensation chain stabilizing apparatuses of claim 1 is disposed in the elevator shaft.

12. The elevator shaft of claim 11, wherein the elevator shaft has at least one compensation chain stabilizing apparatus which is disposed at the bottom of the shaft and corresponds to the position of the compensation chain.

13. The elevator shaft of claim 12, wherein the magnetic field generating device of the compensation chain stabilizing apparatus is aligned with a bottom U-shaped region of the compensation chain in a vertical direction.

14. An elevator system, comprising a shaft, a car in the shaft, a counterweight support, and a compensation chain installed between the car and the bottom of the counterweight support, the compensation chain being at least partially made of a magnetic material, wherein the elevator system further comprises one or more compensation chain stabilizing apparatuses of claim 1, and the magnetic field generating device is configured to generate a magnetic field to limit shaking of the compensation chain.

15. The elevator system of claim 14, wherein the elevator system has at least one compensation chain stabilizing apparatus which is disposed at the bottom of the shaft and corresponds to the position of the compensation chain.

16. The elevator system of claim 15, wherein the magnetic field generating device of the compensation chain stabilizing apparatus is aligned with a bottom U-shaped region of the compensation chain in a vertical direction.

17. A method for preventing shaking of a compensation chain in an elevator system, wherein a compensation chain at least partially made of a magnetic material is used, and an electromagnet configured as a magnetic field generating device is disposed near the compensation chain, so as to limit shaking of the compensation chain, wherein the method includes sensing at least one of shaking amplitude and position of the compensation chain and controlling the electromagnet in response to the at least one of shaking amplitude and position of the compensation chain.

18. The method of claim 17, wherein the method further comprises disposing the magnetic field generating device at the bottom of a shaft and aligning the magnetic field generating device with a bottom U-shaped region of the compensation chain.

19. The method of claim 17, wherein the method further comprises disposing an isolating device between the magnetic field generating device and the compensation chain.

20. The method of claim 17, wherein the method further comprises disposing an isolating plate or an isolating cover, which has a smooth surface facing the compensation chain, between the magnetic field generating device and the compensation chain.

21. The method of claim 17, wherein the method further comprises adjusting a vertical height of the magnetic field generating device by using an adjustable support capable of adjusting a height in a vertical direction.

22. The method of claim 17, wherein the method further comprises operating the electromagnet based on an operation status of a car or a status of the compensation chain.

* * * * *